US009318278B2

(12) United States Patent
Lammers et al.

(10) Patent No.: US 9,318,278 B2
(45) Date of Patent: Apr. 19, 2016

(54) DRIVING ROD FOR MEDIUM VOLTAGE SWITCHING ELEMENT GEAR

(71) Applicants: Arend Lammers, TV Hengelo (NL); Gerard Schoonenberg, CR Hengelo (NL)

(72) Inventors: Arend Lammers, TV Hengelo (NL); Gerard Schoonenberg, CR Hengelo (NL)

(73) Assignee: EATON INDUSTRIES (NETHERLANDS) B.V., Hengelo (NL)

( * ) Notice: Subject to any disclaimer, the term of this patent is extended or adjusted under 35 U.S.C. 154(b) by 29 days.

(21) Appl. No.: 14/361,715

(22) PCT Filed: Nov. 29, 2012

(86) PCT No.: PCT/EP2012/073957

§ 371 (c)(1),
(2) Date: May 30, 2014

(87) PCT Pub. No.: WO2013/079591

PCT Pub. Date: Jun. 6, 2013

(65) Prior Publication Data

US 2014/0284192 A1 Sep. 25, 2014

(30) Foreign Application Priority Data

Nov. 30, 2011 (EP) ..... 11191416

(51) Int. Cl.

| | |
|---|---|
| ***H01H 33/24*** | (2006.01) |
| ***H01H 3/02*** | (2006.01) |
| ***H01H 33/60*** | (2006.01) |
| ***H01H 33/666*** | (2006.01) |

(52) U.S. Cl.

CPC ..... *H01H 3/02* (2013.01); *H01H 33/24* (2013.01); *H01H 33/60* (2013.01); *H01H 33/666* (2013.01)

(58) Field of Classification Search

CPC ..... H01H 33/06; H01H 33/42; H01H 9/0027
See application file for complete search history.

(56) References Cited

U.S. PATENT DOCUMENTS 3,471,669 A * 10/1969 Curtis ..... H01H 9/04 200/302.1
4,002,867 A * 1/1977 Cherry ..... H01H 33/66261 218/134
4,123,618 A * 10/1978 Cushing ..... H01B 17/26 165/104.21
4,587,390 A * 5/1986 Gray ..... H01H 33/666 200/400

(Continued)

FOREIGN PATENT DOCUMENTS

EP 1724802 A2 11/2006
EP 2187416 A1 5/2010

(Continued)

OTHER PUBLICATIONS

A. Grill, "Electrical and optical properties of diamond-like carbon", Thin Solid Films 355-356, Dec. 1999, pp. 189-193.

*Primary Examiner* — Truc Nguyen
(74) *Attorney, Agent, or Firm* — Leydig, Voit & Mayer, Ltd.

(57) ABSTRACT

A device for medium or high voltage switching element gear, the device having: a switching element for connecting two conductors: and a driving rod for operating the switch, wherein the driving rod comprises at least a surface layer of an electrically high resistance material. The electrically high resistance material ensures that a small current will flow through the material due to the present electrical field. This small current will cause a heating of the driving rod, such that condensation is reduced or prevented.

9 Claims, 2 Drawing Sheets

(56) References Cited

U.S. PATENT DOCUMENTS

| | | | | |
|---|---|---|---|---|
| 7,802,480 | B2 * | 9/2010 | Mosely | H01H 33/668 218/121 |
| 7,852,180 | B2 * | 12/2010 | Gentsch | B29C 45/14639 218/118 |
| 8,530,773 | B2 * | 9/2013 | Yoshitomo | B29C 70/22 218/18 |
| 2004/0035828 | A1 * | 2/2004 | Jianchang | H01H 33/664 218/123 |
| 2004/0159635 | A1 * | 8/2004 | Sato | H01H 33/666 218/154 |
| 2006/0231529 | A1 | 10/2006 | Daharsh et al. | |
| 2007/0090095 | A1 * | 4/2007 | Yoshida | H01H 33/66207 218/118 |

FOREIGN PATENT DOCUMENTS

| | | | | |
|---|---|---|---|---|
| GB | 917036 | A | 1/1963 | |
| JP | 2008-277014 | * | 11/2008 | H01H 33/42 |

* cited by examiner

DRIVING ROD FOR MEDIUM VOLTAGE SWITCHING ELEMENT GEAR

CROSS-REFERENCE TO RELATED APPLICATIONS

This application is a U.S. National Stage Application under 35 U.S.C. §371 of International Application No. PCT/EP2012073957, filed on Nov. 29, 2012, and claims benefit to European Patent Application No. 11191416.4, filed on Nov. 30, 2011. The International Application was published in English on Jun. 6, 2013, as WO 2013/079591 A1 under PCT Article 21(2).

FIELD

The invention relates to a device for medium or high voltage switching element gear.

BACKGROUND

In medium or high voltage switching element gear conductors are typically connected to a power rail or busbar through switches. These switches have at least two contacts which can be brought in contact with each other. As the voltages are high, these contacts need to be operated by a mechanism to safely bring the contacts in contact with each other. The mechanism typically uses a driving rod to drive one of the contacts to the statically arranged other contact.

The switching element itself can be insulated by surrounding the switching element with a sufficient layer of insulating material, such as air. This prevents flashover from the switching element to the outside world of a switch, like the housing. However, the driving rod will provide a bridge between the switching element and the housing. To prevent short-circuiting or flashover, the driving rod is at least partially made of an insulating material.

In optimal conditions the driving rod does not provide any problems with regard to flashover. However, when the insulating gas, like air at ambient conditions, used for insulating the switching element is humid, condensation could occur on the driving rod. This condensation reduces the insulation properties of the driving rod and could lead to flashover. Also pollution of the driving rod could reduce the insulation or provide concentrations in the electrical field, which also could lead to flashover.

SUMMARY

An aspect of the invention provides a device for a medium or high voltage switching element gear, the device comprising: a switching element configured to connect two conductors; and a driving rod configured to operate the switching element, wherein the driving rod includes a surface layer including an electrically high resistance material.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
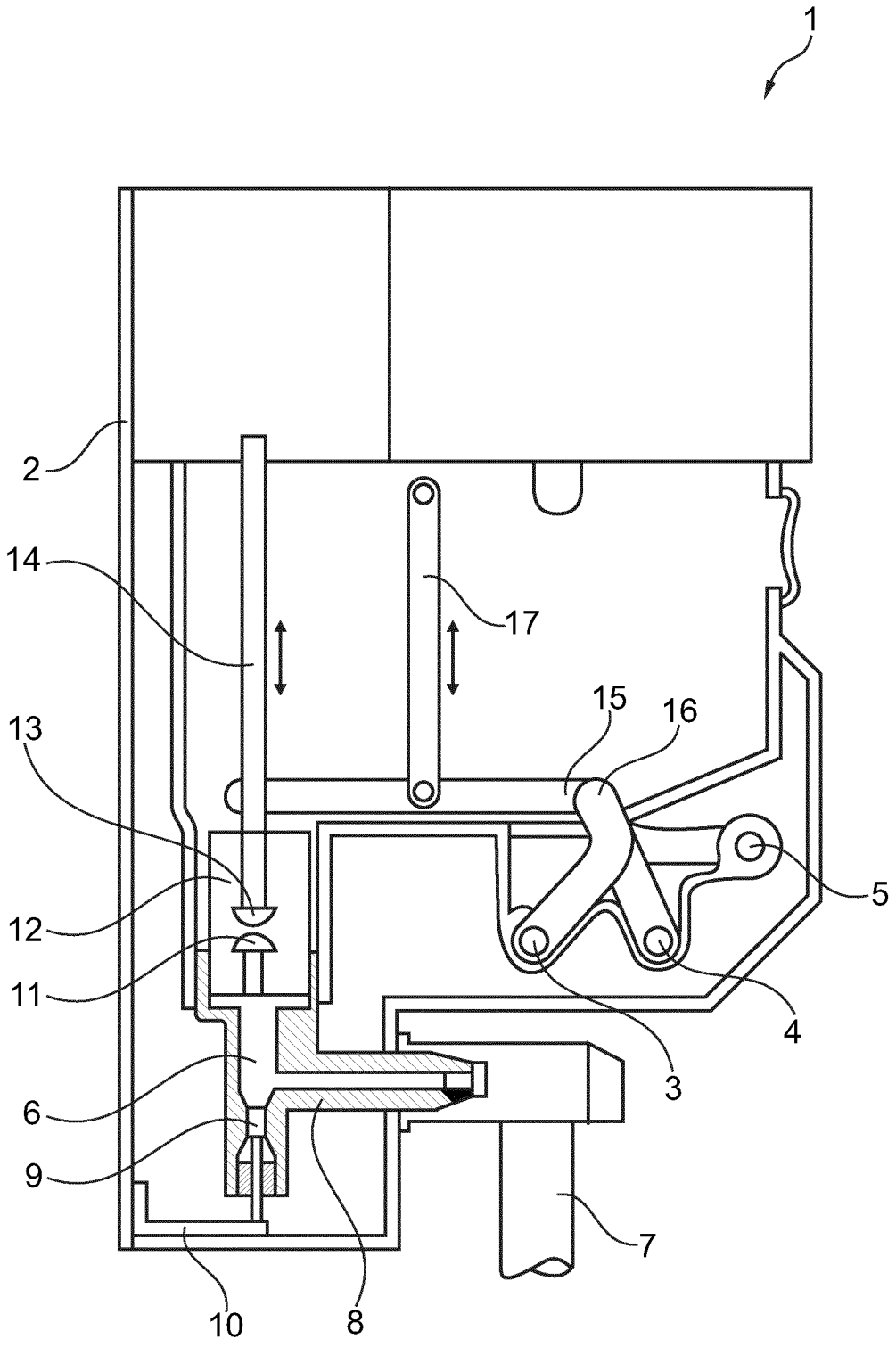
FIG. 1 shows a schematic cross sectional view of an embodiment of switching element gear.

An aspect of the invention can reduce or even remove the above mentioned disadvantages, preferably providing a device for medium or high voltage switching element gear, the device comprising: a switching element for connecting two conductors; and a driving rod for operating the switch.

An aspect of the invention provides a device according to the invention, which is characterized in that the driving rod comprises at least a surface layer of an electrically high resistance material. This high resistance material has a high resistance, but should not be a perfect isolator.

The electrically high resistance material allows that a small current will flow through the material due to the present voltage difference across the driving rod. This small current will cause a heating of the driving rod, such that condensation is reduced or prevented.

Also an homogeneous electrical field will be present along the driving rod due to the current in the driving rod. The current flow through the high resistance material will level out any spot, where electrical field concentrations would have occurred without the high resistance material. The homogeneous electrical field ensures that water drops of any condensation or any pollution has less to no influence on the chance of flashover.

The driving rod could be made partially or fully of the electrically high resistance material or the driving rod could be coated with the electrically high resistance material.

By coating the driving rod with the electrically high resistance material, the core of the driving rod could be made of a material, which is more suitable for withstanding the mechanical forces needed for operating the switch. In this embodiment the characteristics of the electrically high resistance material could be optimized for providing an homogeneous electrical field.

The coating could for example be a dispersion of insulating particles and electrical conducting particles. More preferably, the coating is a nanocoating. A nanocoating provides the possibility to integrate at an atomic level characteristics of different materials, such that a coating can be obtained with a high electrical resistance.

In yet another embodiment of the device according to the invention, the switching element could be a vacuum interrupter or a disconnector. Also both types of switches could be present in switching element gear. In such a case, the vacuum interrupter is used for switching any electrical current in daily practice, while the disconnector is used in addition when servicing the switching element gear.

In still another preferred embodiment of the device an electrical measuring contact is arranged on the surface layer on the driving rod and comprises the device further indicator means for indicating or measuring the voltage on the electrical contact.

Because a small current is generated in the surface layer of an electrically high resistance material, a specific voltage is present at the contact. This voltage is indicative for whether the switching element is switched on or switched off. The measured voltage can also be indicative for the voltage on the main contacts of the switch, as the measured voltage is a derivative thereof.

FIG. 1 shows switching element gear 1. This switching element gear 1 has a housing 2 in which three busbars 3, 4, 5 are arranged. Furthermore, an input conductor 6 is arranged in the housing to which a cable 7 is connected. The input conductor 6 is isolated with an insulation layer 8.

The insulation layer 8 is provided with a piercable part 9, which is pierced by a pin 10 connected to the housing, when an internal arc occurs.

The input conductor 6 is connected to a static contact 11 of a vacuum interrupter 12. The movable contact 13 is arranged to a driving rod 14, with which the contact 13 is brought in contact with the static contact 11 or moved away therefrom.

The movable contact 13 is connected through a sliding contact with a first contact 15 of a disconnector. This first contact 15 is, as shown in FIG. 1, in contact with the second contact 16 of the disconnector. The second contact 16 is in turn connected to one of the busbars 3.

The disconnector with contacts 15, 16 further comprises also a driving rod 17, which is used to open the connection between the contacts 15, 16.

So, the switching element gear 1 shown in FIG. 1 comprises two separate switches 11, 12, 13 and 15, 16, which are each operated by a respective driving rod 14, 17.

Figure 2:
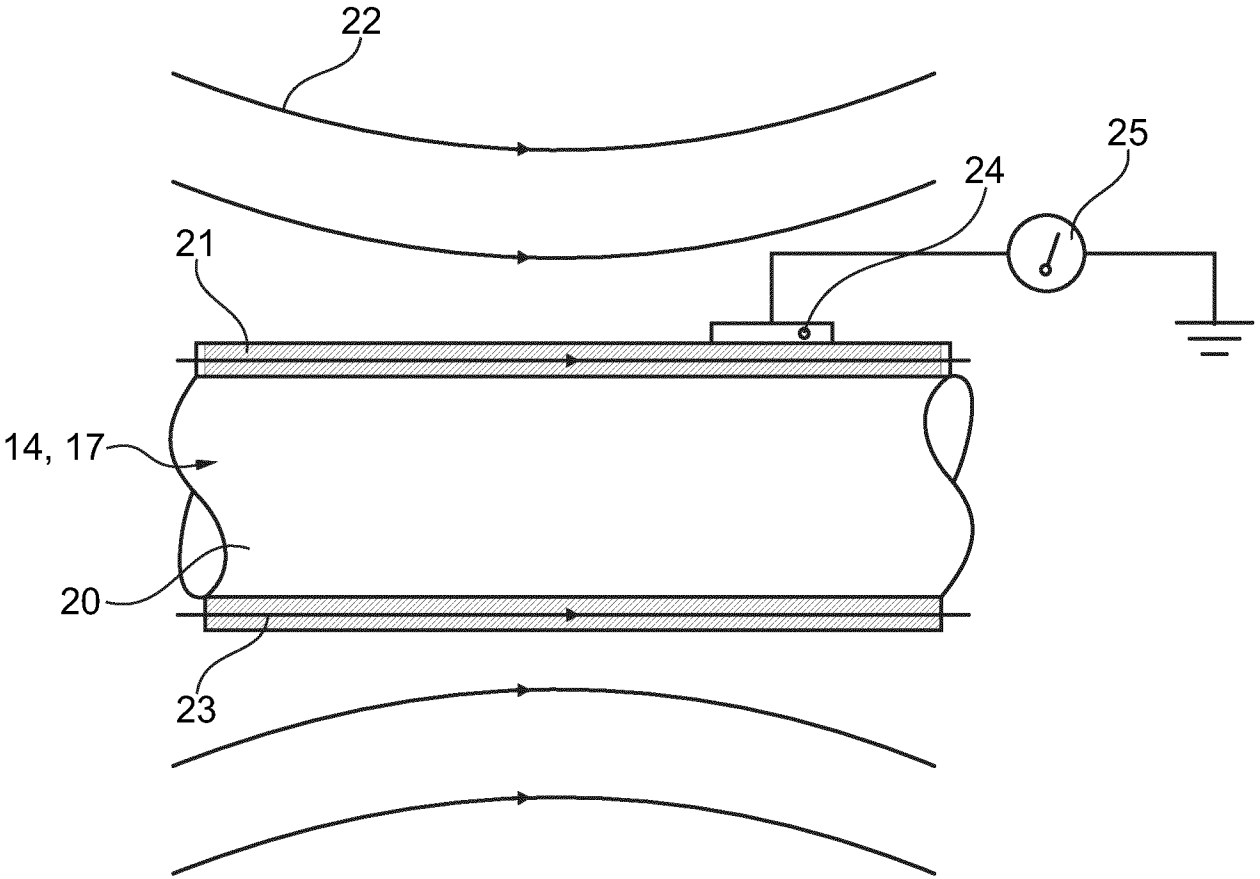
FIG. 2 shows a schematic partial side view of a device according to the invention.

FIG. 2 shows a schematic partial view of either driving rod 14, 17. The driving rod 14, 17 has a core 20 of preferably a strong non conducting material, which is capable of transferring the forces for moving the respective contacts 13, 15.

The core 20 is provided with a surface layer 21 of an electrically high resistance material. Due to the electrical field 22 present in the switching element gear 1, an electrical current 23 is generated within the surface layer 21. This current 23 will generate some heat within the surface layer 21 as a result of the high resistance material. The heat will reduce any condensation on the driving rod 14, 17.

Another advantage of the surface layer 21 of electrically high resistance material is that the electrical field 22 is homogenously distributed over the surface of the driving rods 14, 17.

By arranging a contact 24 to the surface layer 21 it is possible to measure the electrical potential with a measuring device 25. This measurement is indicative for the presence of electrical current on the contacts 13, 15. The measurement can also be used as a derivative of the primary voltage on the contacts 13, 15.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. A device for a medium or high voltage switching element gear, the device comprising:

a switching element configured to connect two conductors; and a driving rod configured to operate the switching element, wherein the driving rod includes a surface layer including an electrically high resistance material, wherein the surface layer includes a dispersion including insulating particles and electrical conducting particles.

2. The device of claim 1, wherein the driving rod is coated with electrically high resistance material.

3. The device of claim 1, wherein the surface layer is a nanocoating.

4. The device of claim 3, wherein the nanocoating has super-hydrophobic properties.

5. The device of claim 1, wherein the switching element is a vacuum interrupter.

6. The device of claim 1, wherein the switching element is a disconnector.

7. The device of claim 1, further comprising:

an electrical contact arranged on the surface layer of the driving rod; and an indicator configured to indicate the voltage on the electrical contact.

8. The device of claim 1, wherein the electrically high resistance material is not a perfect isolator.

9. The device of claim 1, wherein electrically high resistance material allows that a current to flow through the material high resistance material in the present of a voltage difference across the driving rod.

* * * * *